US005959400A

United States Patent [19]

Niigaki et al.

[11] Patent Number: 5,959,400

[45] Date of Patent: Sep. 28, 1999

[54] ELECTRON TUBE HAVING A DIAMOND FIELD EMITTER

[75] Inventors: Minoru Niigaki; Toru Hirohata; Hirofumi Kan; Masami Yamada, all of Hamamatsu, Japan

[73] Assignee: Hamamatsu Photonics K.K., Hamamatsu, Japan

[21] Appl. No.: 08/950,177

[22] Filed: Oct. 14, 1997

[30] Foreign Application Priority Data

Oct. 14, 1996 [JP] Japan ..... 8-270786

[51] Int. Cl.[6] ..... H01J 1/30

[52] U.S. Cl. ..... 313/495; 313/336

[58] Field of Search ..... 313/309, 336, 313/351, 495, 496, 497, 422

[56] References Cited

U.S. PATENT DOCUMENTS

| | | | |
|---|---|---|---|
| 3,432,712 | 3/1969 | Benda . | |
| 3,552,818 | 1/1971 | Benda . | |
| 3,945,698 | 3/1976 | Fukuhara et al. . | |
| 5,396,150 | 3/1995 | Wu et al. | 313/309 |
| 5,430,347 | 7/1995 | Kane et al. | 313/309 |
| 5,543,691 | 8/1996 | Palevsky et al. . | |
| 5,679,895 | 10/1997 | Von Windheim | 313/336 |
| 5,684,356 | 11/1997 | Jeng et al. | 313/336 |

FOREIGN PATENT DOCUMENTS

| | | |
|---|---|---|
| 0 523 494 | 1/1993 | European Pat. Off. . |
| 0 609 532 | 8/1994 | European Pat. Off. . |
| 0 802 559 | 10/1997 | European Pat. Off. . |
| 2 141 145 | 2/1973 | Germany . |
| 7-29483 | 1/1995 | Japan . |
| 96/01492 | 1/1996 | WIPO . |

OTHER PUBLICATIONS

Geis et al, "Capacitance–Voltage Measurements on Metal–$SiO_2$–Diamond Structures Fabricated With (100)–and (111)–Oriented Substrates", IEEE Transactions on Electron Devices, vol. 38, No. 3, Mar. 1991, pp. 619–626.

Schwoebel P R et al: "Field–Emitter Array Performance Enhancement Using Hydrogen Glow Discharges" Jul. 5, 1993, Applied Physics Letters, vol. 63, NR. 1, pp. 33–35 XP000382555 * pp. 428 –429.

Hong D et al: "Field Emission from P–Type Polycrystalline Diamond Films" Mar. 1, 1995, Journal of Vacuum Science and Technology: Part B, vol. 13,NR. 2 pp. 427 –430 XP000508555 * pp. 428 –429.

*Primary Examiner*—Vip Patel
*Assistant Examiner*—Matthew J. Gerike
*Attorney, Agent, or Firm*—Pillsbury Madison & Sutro LLP

[57] ABSTRACT

The present invention relates to an electron tube having a configuration which can maintain its operating stability for a long period of time. The electron tube comprises, at least, a field emitter which is made of diamond or a material mainly composed of diamond and has a surface terminated with hydrogen, and a sealed envelope for accommodating the diamond field emitter. Due to the hydrogen termination, the electron affinity of the diamond field emitter is set to a negative state. Also, hydrogen is enclosed within the sealed envelope. Due to this configuration, the hydrogen-terminated state of the diamond field emitter surface is stabilized, and the electron affinity of the diamond emitter is restrained from changing for a long period of time.

9 Claims, 8 Drawing Sheets

ELECTRON TUBE HAVING A DIAMOND FIELD EMITTER

BACKGROUND OF THE INVENTION

Field of the Invention

The present invention relates to an electron tube and, in particular, to an electron tube equipped with a field emitter.

Related Background Art

As a field emitter which is an electron beam source used for electron tubes, hot-cathode type and field-emission type have conventionally been known. Recently, field-emission type electron sources have been attracting a greater deal of attention due to their high electron emission density. In general, a semiconductor such as Si, or a high-melting point metal such as Mo or W has been used as a material for such a field emitter. Recently, an electron tube equipped with a field emitter made of diamond or a material mainly composed of diamond has been proposed, for example, in EP-B1-0523494 and Japanese Patent Application Laid-Open No. 7-29483.

FIG. 1 is a cross-sectional view showing a configuration of an electron tube equipped with a field emitter made of diamond with (111) crystal plane, which is disclosed in EP-B1-0523494 mentioned above. As depicted, this electron tube comprises, at least, a field emitter (electron source) 110 disposed on a substrate 100; an anode 130 opposing the field emitter 110; and a control electrode 120, disposed between the field emitter 110 and the anode 130, for controlling the emission of electrons from the field emitter 110 to the anode 130 by adjusting a voltage which is set therefor. The field emitter 110 extends toward the anode 130 to form a tip portion 111 from which electrons at Fermi level (FL) are emitted toward the anode 130. From voltage sources 141, 142, and 143, predetermined voltages are applied to the substrate 100, control electrode 120, and anode 130, respectively.

SUMMARY OF THE INVENTION

Having studied the conventional field emitter such as that mentioned above, the inventors have found the following problems.

Diamond field emitters thus attract considerable attention because the difference between the energy at the bottom of conduction band and the energy at vacuum level is small in diamond. In particular, when uncombined carbon atoms in the outermost surface thereof are terminated with hydrogen ($H_2$), the value obtained when the energy at the bottom of conduction band is subtracted from the energy at vacuum level, i.e., electron affinity, becomes zero or negative, thus yielding a so-called negative electron affinity (NEA).

On the other hand, since a field emitter has a taper form with a higher emission current density at its tip, it typically generates a large amount of Joule heat. Accordingly, in the case of a diamond field emitter, even when its surface is terminated with hydrogen, hydrogen may be desorbed therefrom from the above-mentioned heat. Further, after the desorption of hydrogen, the surface of the field emitter may absorb molecules other than hydrogen. Accordingly, such a field emitter may continuously change its electron affinity, and may not always attain zero electron affinity. Such a change in state is intrinsically problematic in terms of the operating stability of the electron tube. Also, it yields a serious problem in terms of performances of the field emitter since the electron emission efficiency may greatly decrease upon a change in its state.

Therefore, an object of the present invention is to provide an electron tube having a configuration which can maintain its operating stability for a long period of time.

The electron tube according to the present invention comprises, at least, an electron beam source for emitting an electron at Fermi level (FL) by a tunnel effect; an anode for receiving the electron emitted from the electron beam source; and a sealed envelope for accommodating, at least, the electron beam source and anode.

In particular, the electron beam source is made of diamond or a material mainly composed of diamond, and has a surface terminated with hydrogen. Also, hydrogen is enclosed within the sealed envelope. Due to this configuration, the field emitter surface is always set to a predetermined negative electron affinity.

In this electron tube, from the viewpoint of electron emission efficiency, the electron beam source is preferably a field emitter made of polycrystalline diamond.

In the electron tube according to the present invention, the partial pressure of hydrogen enclosed within the sealed envelope is preferably within the range of $1\times10^{-6}$ to $1\times10^{-3}$ torr. When the hydrogen partial pressure is set within this range, a more stable operations can be secured. Namely, when the hydrogen partial pressure is higher than $1\times10^{-3}$ torr, discharge is more likely to occur within the electron tube. When the hydrogen partial pressure is lower than $1\times10^{-6}$ torr, on the other hand, it takes a very long time for hydrogen to be absorbed again by the polycrystalline diamond field emitter surface after being desorbed therefrom, whereby other remaining molecules within the electron tube are more likely to be absorbed by the polycrystalline diamond field emitter surface, thus losing the effects obtained by hydrogen being enclosed therein.

The field emitter in the electron tube according to the present invention preferably has a form tapering toward the anode. In this case, electrons are emitted from the tip of the field emitter, thus yielding a high electron emission density. The electron tube according to the present invention may comprise a plurality of field emitters each having a form tapering toward the anode. These field emitters may be two-dimensionally arranged with predetermined intervals on a plane opposing the anode.

In the electron tube according to the present invention, the anode may include a fluorescent screen which emits light when the electron emitted from the electron beam source is incident thereon. When such a fluorescent screen and a plurality of field emitters which are two-dimensionally disposed on a predetermined plane are combined together, two-dimensional information can be displayed as well.

In this configuration, a plurality of control electrodes may be disposed between the individual field emitters and the anode so as to correspond to the respective field emitters. Also, a focusing electrode may be disposed between each control electrode and the anode so as to correspond to each field emitter.

The "field emitter" used herein refers to an electron beam source (field-emission type electron source) which emits electrons at Fermi level (FL) by a tunnel effect. Accordingly, it is intrinsically different from a photocathode that is an electrode for emitting photoelectrons which have been excited to a conduction band from a valence band by incident light.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Figure 1:
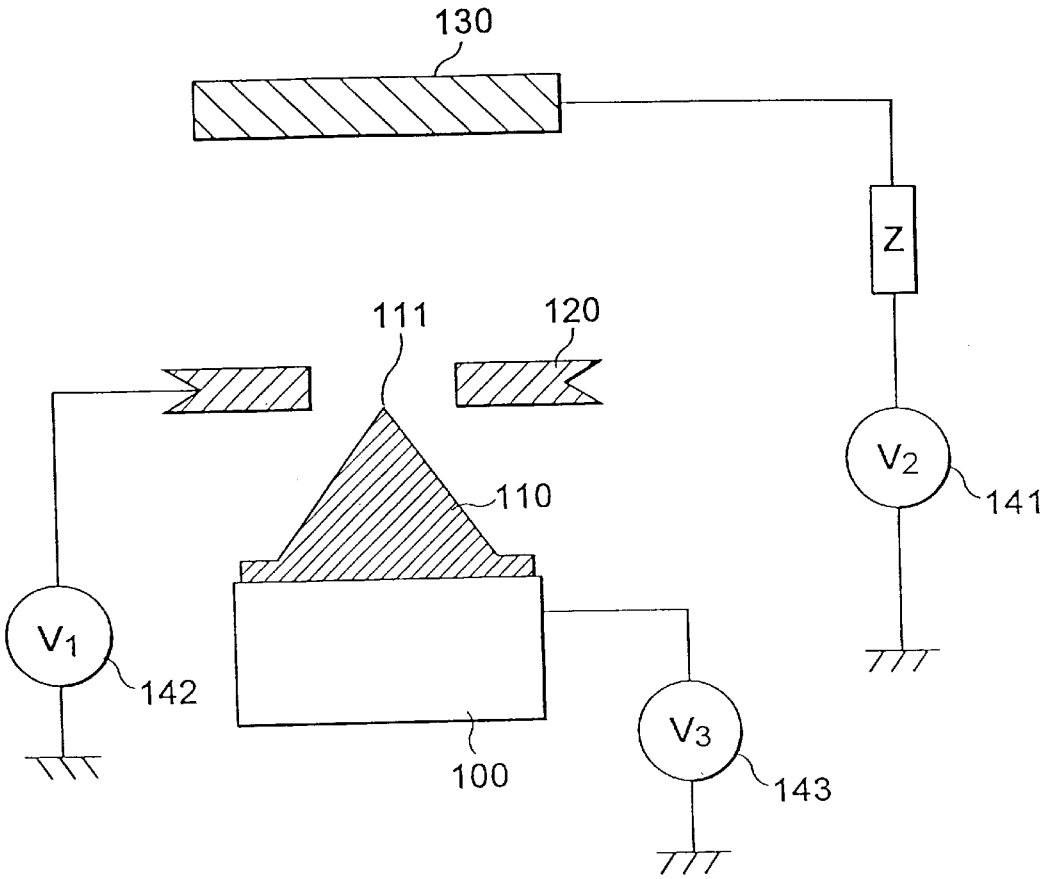
Fig.1 (PRIOR ART)
FIG. 1 is a sectional view showing a configuration of a conventional electron tube equipped with a field emitter made of monocrystal diamond.

In the following, preferred embodiments of the present invention will be explained in detail with reference to FIGS. 2 to 13. In the drawings, parts identical or equivalent to each other will be referred to with marks identical to each other.

Figure 2:
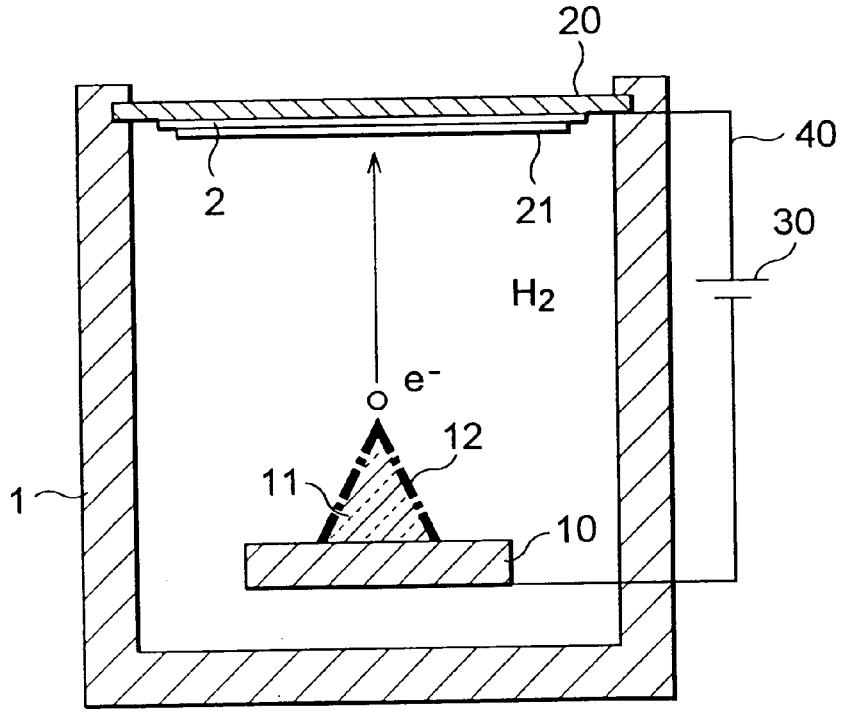
FIG. 2 is a sectional side view schematically showing the configuration of a first embodiment of the electron tube according to the present invention.

FIG. 2 is a sectional side view schematically showing the configuration of a first embodiment of the electron tube according to the present invention and, in order to explain its basic operations, relative arrangement of its electric system and parts corresponding to a single pixel.

As shown in FIG. 2, the electron tube according to the first embodiment has a diode configuration. Namely, in a sealed envelope 1, a field emitter 11 with a pointed tip is disposed on a conductive platform 10. A film-like phosphor 21 (fluorescent screen), as an anode, is disposed on a conductive transparent film 2 on a glass faceplate 20 so as to oppose the tip of the field emitter 11. Preferably, the field emitter 11 is made of polycrystalline diamond, and its electron affinity may become negative in response to its surface state. In order to apply a positive high voltage to the phosphor 21 with respect to the field emitter 11, a DC power source 30 is connected between the platform 10 and the conductive transparent film 2 through electric leads 40. Further, in this embodiment, hydrogen is enclosed within the sealed envelope 1, whereby the surface of diamond constituting the field emitter 11 is terminated with hydrogen 12. Consequently, the surface of the field emitter 11 exhibits a negative electron affinity. Preferably, the partial pressure of hydrogen within the sealed envelope 1 is such that no discharge is generated by hydrogen therein, e.g., $1\times10^{-3}$ torr or less, but at least $1\times10^{-6}$ torr in order to maintain the surface state of the field emitter 11.

When a predetermined voltage is applied to the field emitter 11 from the DC power source 30, an electron ($e^-$) at Fermi level (FL) is emitted, due to a tunnel effect, from the tip of the field emitter 11 into a hydrogen-containing low-pressure atmosphere. Here, the electron is easily emitted since the diamond surface terminated with hydrogen 12 has a low work function. When this electron is made incident on the phosphor 21 to which a positive voltage is applied with respect to the field emitter 11, the phosphor 21 emits light.

Figure 3:
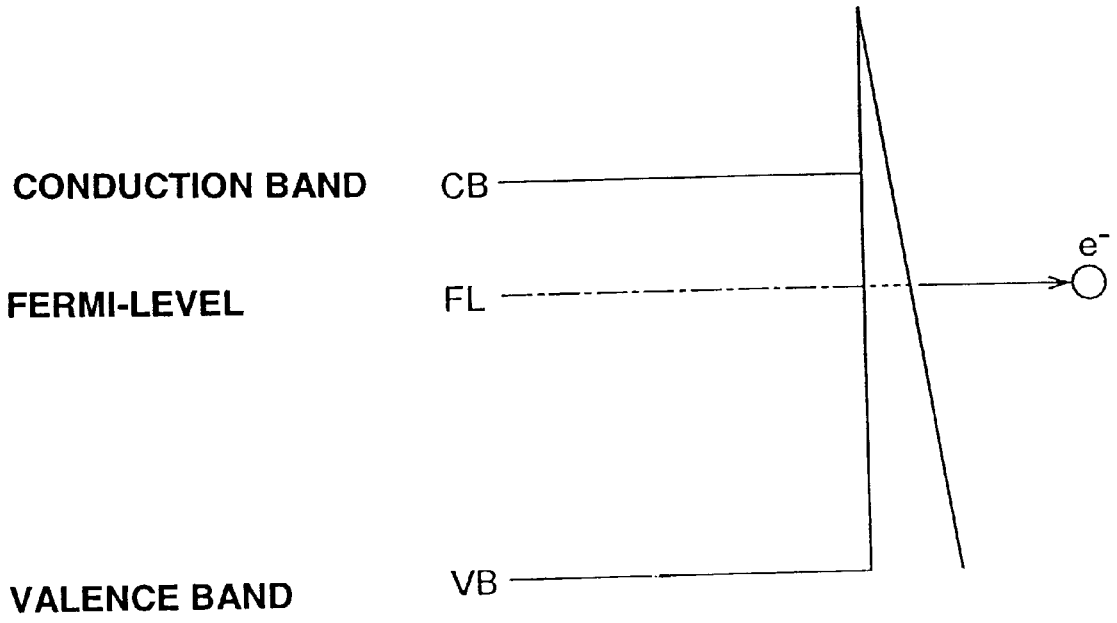
FIG. 3 is an energy band diagram for explaining a process in which an electron is emitted from a field emitter.
Figure 4:
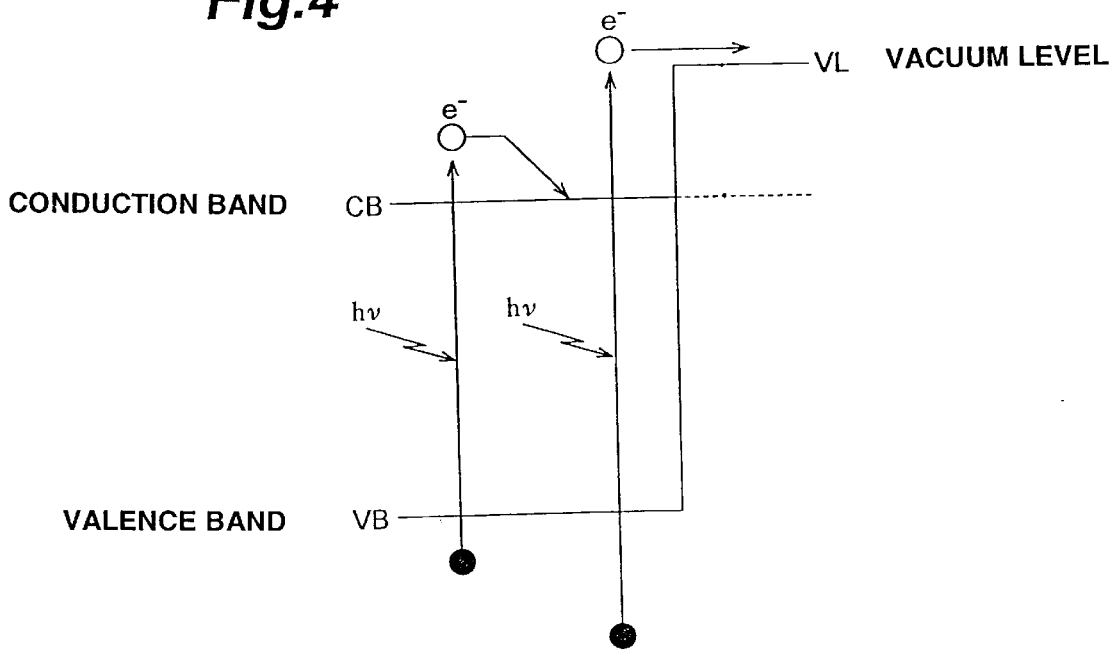
FIG. 4 is an energy band diagram for explaining a process in which photoelectrons are emitted from a CsI photocathode.
Figure 5:
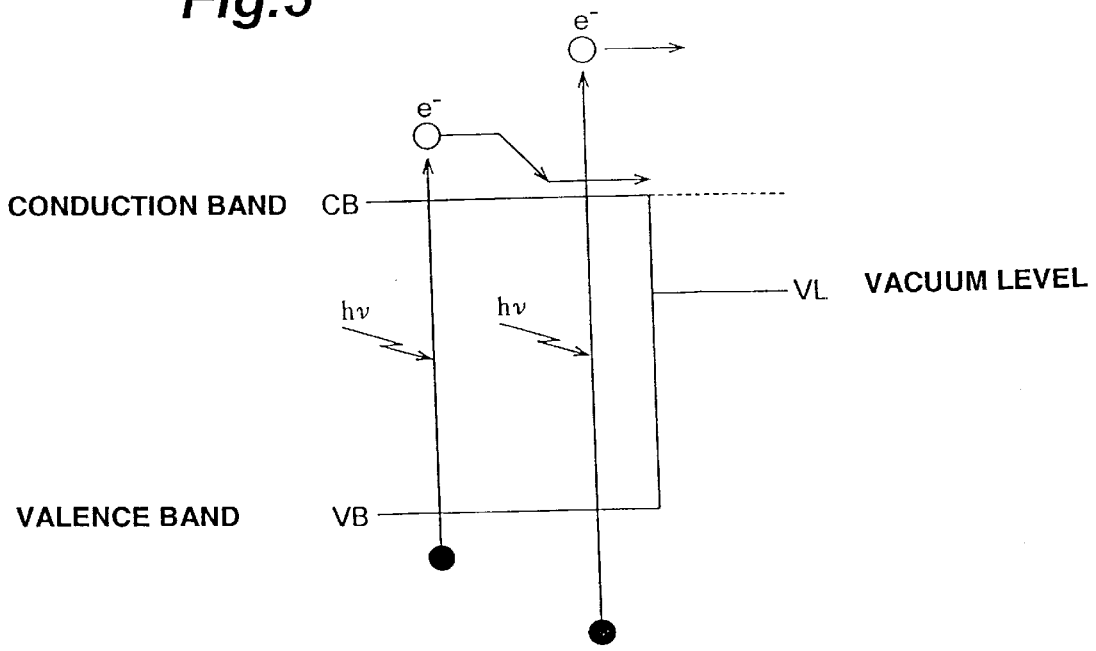
FIG. 5 is an energy band diagram for explaining process in which photoelectrons are emitted from a NEA photocathode.

Here, it should be note that the field emitter according to the present invention is essentially different from a photocathode. A device known in general as field emitter is a device which emits a Fermi-level (FL) electron into a vacuum (in a vacuum space where the field emitter is disposed) through a tunnel effect, as shown in FIG. 3, when a strong electric field ($>10^6$ V/cm) is applied to a surface of a metal or semiconductor. Namely, as can be seen from FIG. 3, the emitted electron is a Fermi-level (FL) electron and not a so-called photoelectron which is an electron excited from a valence band (VB) to a conduction band (CB). Here, FIG. 3 is an energy band diagram for explaining a process in which an electron is emitted from the field emitter. By contrast, as shown in FIGS. 4 and 5, for example, a photocathode is an electrode which emits into a vacuum a photoelectron which is excited from a valence band to a conduction band by incident light. It is essentially different from the field emitter that emits into a vacuum the Fermi-level (FL) electron through a tunnel effect. Also, in the photocathode, a strong electric field on the surface is not always necessary. For the photocathode, field-emitted electrons generated by a strong electric field may become dark current and rather deteriorate its performance. FIGS. 4 and 5 are energy band diagrams for explaining processes in which photoelectrons are emitted from an CsI and NEA photocathodes, respectively.

Here, a large amount of Joule heat is generated at the tip of the field emitter 11 since the emission current density is very high there. Consequently, in the field emitter 11 of this embodiment, hydrogen 12 absorbed by the tip surface is in a state where it is likely to be desorbed. After hydrogen 12 is desorbed therefrom, residues other than hydrogen in the sealed envelope 1 may be absorbed by the tip of the field emitter 11. When the electron emitted from the tip of the field emitter 11 is made incident on the phosphor 21 while being accelerated, molecules and the like absorbed by the phosphor 21 may be ionized and released into the inner space of the sealed envelope 1, thereby being absorbed by the surface of the tip of the field emitter 11. Phenomena such as those mentioned above are problems inherent in electron tubes which utilize field-emission. When absorption or desorption occurs at the tip surface of the field emitter 11, its work function changes, whereby the electron emission efficiency of the field emitter 11 changes as well.

In the electron tube according to the present invention, unlike the conventional electron tube (FIG. 1), a predetermined pressure of hydrogen is enclosed within the sealed envelope 1. For example, in the case where hydrogen with a partial pressure of $1\times10^{-6}$ torr is enclosed within the sealed envelope 1, thus enclosed hydrogen impinges on the surface of the field emitter 11 at a frequency of about $1.4\times10^{16}$ pieces/($cm^2$ second). In general, the outermost layer of a solid has an atom density of about $1\times10^{15}$ pieces/$cm^2$. Accordingly, when hydrogen 12 terminating the surface of the field emitter 11 is desorbed therefrom due to the Joule heat generated by electron emission, the surface is terminated again with enclosed hydrogen within about 0.1 second. Also, in the case where ions generated when electrons are made incident on the molecules remaining within the sealed envelope 1 or the phosphor 21 are absorbed by the diamond surface, they are substituted by hydrogen which exists within the sealed envelope 1 in a relatively large amount. Namely, the surface of the field emitter 11 is constantly terminated with hydrogen, whereby its work function is unchanged. Thus, in the field emitter, a stable emission current density is efficiently obtained. Here, it is preferable that parts such as phosphor used in this embodiment do not substantially emit gas under a reduced pressure.

A method of making such a field emitter will be explained with reference to FIGS. 6 to 10. These drawings are views schematically showing processes for making the field emitter according to the present invention, respectively.

Figure 6:
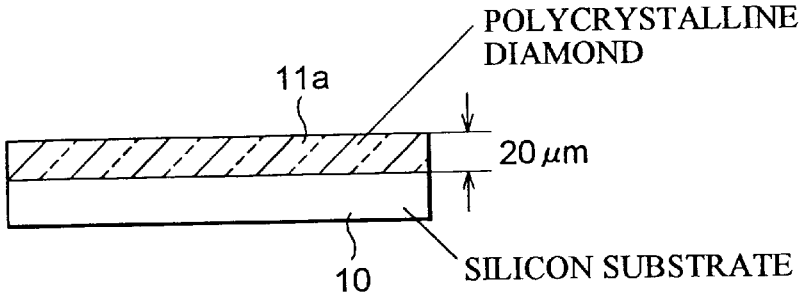
FIGS. 6–10 are views schematically showing processes for making the field emitter according to the present invention, respectively.

First, as shown in FIG. 6, a polycrystalline diamond film having a thickness of about 20 $\mu$m is formed on an Si(100) substrate by microwave plasma CVD technique. In this case, methane gas ($CH_4$)+hydrogen ($H_2$) is used as a material gas, and the diamond film is formed under the condition where microwave output is 1.5 kW, pressure is 50 torr, and film-forming temperature is 850° C.

Though microwave plasma CVD is used for forming the polycrystalline film in this case, the present invention is not essentially restricted in terms of the film-forming method. For example, hot filament CVD technique and the like may be used.

Figure 7:
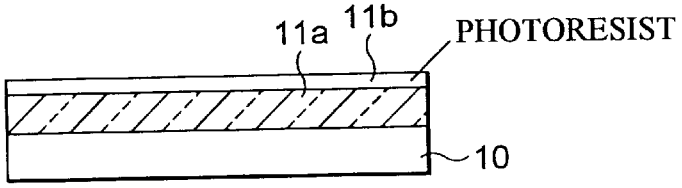
Figure 8:
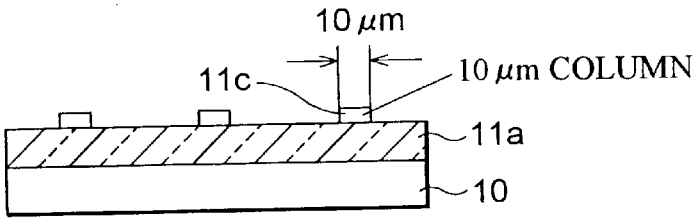

Next, as shown in FIG. 7, photoresist is applied to the whole surface of polycrystalline diamond. Then, as shown in FIG. 8, while circular portions each having a diameter of about 10 $\mu$m are left by means of a predetermined photomask, the remaining portions of photoresist are eliminated.

Figure 9:
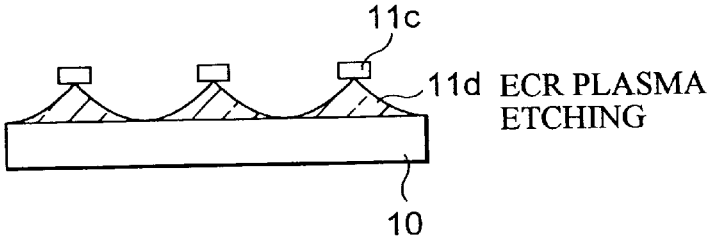

Further, the resulting product is dry-etched by an ECR plasma etching apparatus. Since etching is effected in an isotropic manner, the portions under the remaining photoresist are left in the form of protrusions as shown in FIG. 9. Here, the form and interval of protrusions and the like can be accurately controlled by the polycrystalline diamond film thickness, mask form, etching time, and the like.

Figure 10:
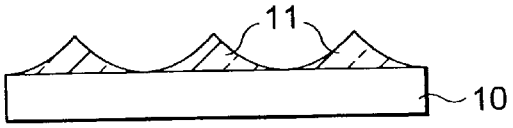

Finally, the remaining photoresist is eliminated, whereby the field emitter 11 such as that shown in FIG. 10 is formed.

Also, in order to make display devices each having a pixel with a diode configuration, the following procedure is taken. First, field emitters 11 having uniform shapes (formed by the foregoing process) are two-dimensionally arranged on the platform 10. Also, the phosphor 21 (fluorescent screen) is disposed on the conductive transparent film 2 on the glass faceplate 20. Subsequently, the platform 10, on which a plurality of field emitters 11 are mounted, is disposed within the sealed envelope 1. Also, it is made to oppose the tip portion of the field emitter 11 from which electrons are emitted. In this state, after the sealed envelope 1 is evacuated till the pressure therein becomes $1\times10^{-8}$ torr or lower, a predetermined pressure of hydrogen is introduced therein.

Figure 11:
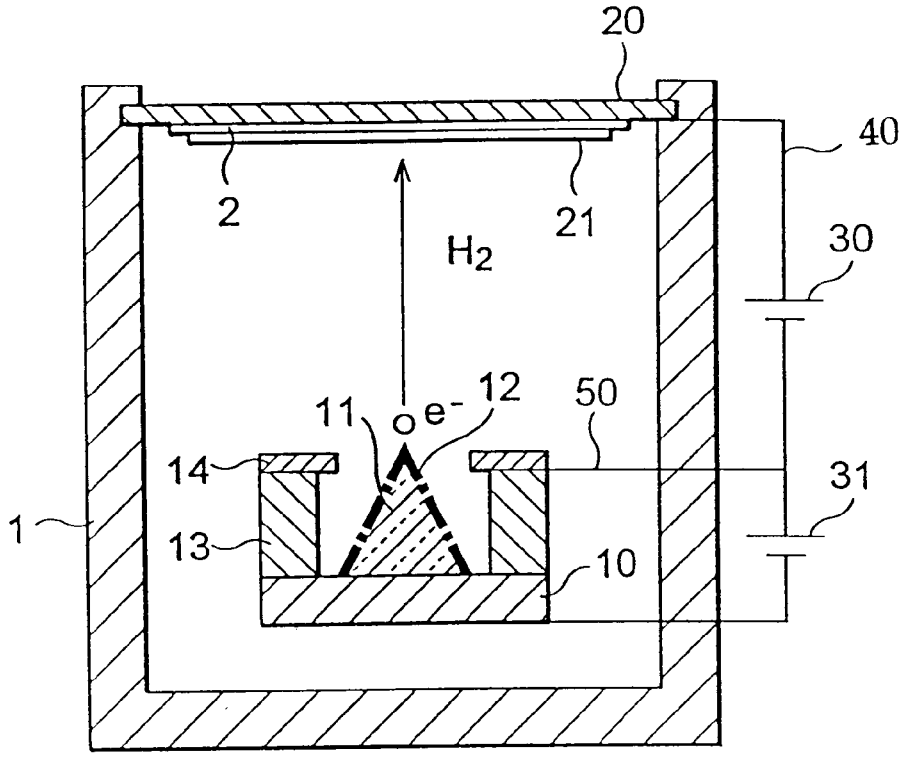
FIG. 11 is a sectional side view schematically showing the configuration of a second embodiment of the electron tube according to the present invention.

The electron tube according to the present invention should not be limited to the one having a diode configuration such as that mentioned above. In a second embodiment of the electron tube according to the present invention, unlike the first embodiment (FIG. 2), a triode configuration is employed. FIG. 11 is a view schematically showing the configuration of the electron tube according to the second embodiment. In the second embodiment, unlike the diode configuration, a ring-shaped gate electrode 14 is disposed on a ring-shaped insulating film 13 which is mounted on the platform 10 so as to surround the field emitter 11 within the sealed container 1. Also, in order to apply a positive voltage to the gate electrode 14 with respect to the field emitter 11, a DC power source 31 is further connected between the gate electrode 14 and the platform 10 through electric leads 40. In such a configuration, when a predetermined voltage is applied to the gate electrode 14, electrons emitted from the field emitter 11 are controlled by the gate electrode 14. Also, as with the first embodiment, hydrogen with a partial pressure within the range of $1\times10^{-6}$ to $1\times10^{-3}$ torr is enclosed within the sealed envelope 1 in the second embodiment. Accordingly, the emission current at the tip of the field emitter 11 having a hydrogen-terminated surface is controlled by the gate electrode 14, thus yielding more stable operations.

Figure 12:
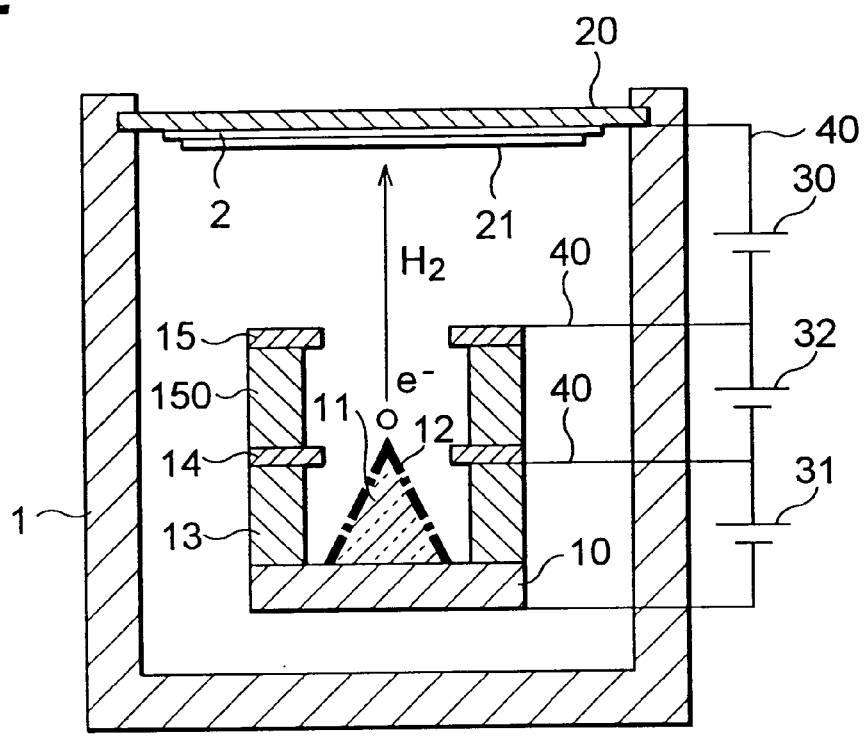
FIG. 12 is a sectional side view schematically showing the configuration of a third embodiment of the electron tube according to the present invention.

A third embodiment of the electron tube according to the present invention has a tetrode configuration in which a ring-shaped focusing electrode 15 is further disposed on a ring-shaped insulating film 150 on the gate electrode 14 in the triode configuration of the second embodiment. FIG. 12 is a view schematically showing the configuration of the electron tube according to the third embodiment. In the third embodiment, unlike the triode configuration, the ring-shaped focusing electrode 15 is disposed on the insulating film 150 on the gate electrode 14. In order to apply a negative voltage to the focusing electrode 15 with reference to the gate electrode 14, a DC power source 32 is further connected between the focusing electrode 15 and the gate electrode 14 through electric leads 40.

In such a configuration, when a predetermined voltage is applied to the focusing electrode 15, electrons emitted from the field emitter 11 are converged by the focusing electrode 15. Also, as with the first and second embodiments, hydrogen with a partial pressure within the range of $1\times10^{-6}$ to $1\times10^{-3}$ torr is enclosed within the sealed envelope 1 in the third embodiment. Thus, after the emission current at the tip of the field emitter 11 having a hydrogen-terminated surface is controlled by the gate electrode 14, electrons are converged by the focusing electrode 15, whereby crosstalk between individual pixels can be efficiently suppressed. Accordingly, the electron tube according to the third embodiment can realize a high-resolution display with very stable operations.

Figure 13:
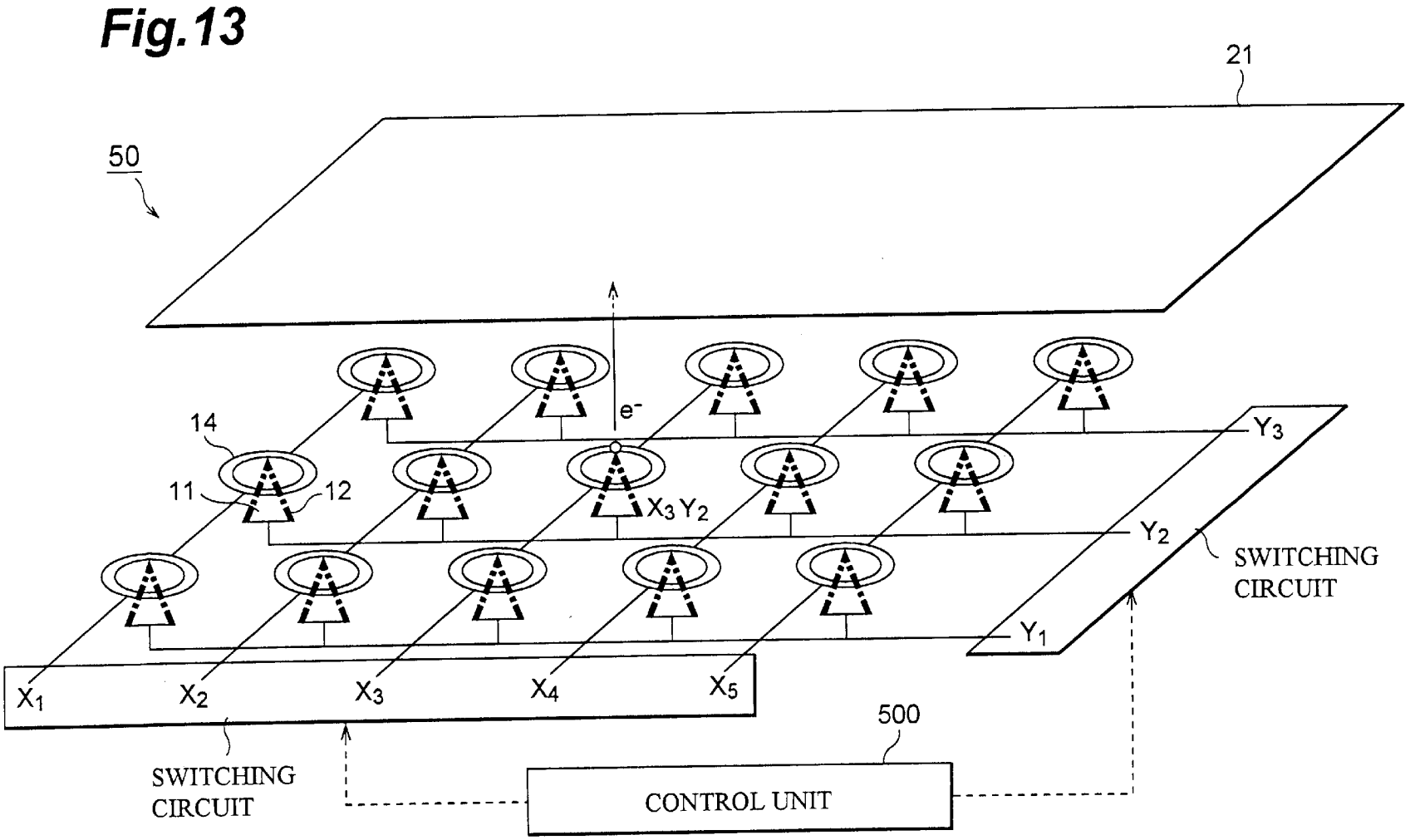
FIG. 13 is a perspective view schematically showing the configuration of a display device in which a plurality of elements each having the triode configuration shown in FIG. 4 are two-dimensionally arranged.

In a display device 50 shown in FIG. 13, a plurality of elements each having the triode configuration of the second embodiment, for example, are arranged two-dimensionally. Namely, a phosphor 21 is disposed so as to oppose the tips of a plurality of field emitters 11. Also, each element has its corresponding switching circuit. The display device 50 is accommodated in a sealed envelope in which hydrogen is enclosed under a reduced pressure state.

In order to emit an electron from a given element, e.g., the field emitter 11 corresponding to a pixel whose address is $X_3Y_2$ as shown in FIG. 13, its corresponding switching circuit is driven by a control unit 500 so as to apply a predetermined voltage between the gate electrode 14 and field emitter 11 in this pixel. The electron emitted from this field emitter 11 impinges on the phosphor 21 at a specific position, whereby light is emitted at this position. Thus, the display device 50 equipped with such field emitter 11 can operate with an excellent stability.

Though the display device 50 shown in FIG. 13 has a triode configuration with no focusing electrode, each pixel may also have a diode or tetrode configuration. Also, the driving system for display may be a time-division dynamic driving system, without being restricted to a static driving system.

In the first to third embodiments, the field emitter is made of hydrogen-terminated diamond as explained in the foregoing. The present invention should not be restricted thereto, however. Namely, the present invention is applicable to all kinds of field emitters whose surface can yield a negative electron affinity with a fixed work function when constantly terminated with hydrogen, by which they can operate efficiently and stably. For example, it is needless to mention that sufficient effects can also be obtained in those mainly composed of carbon-based materials, i.e., diamond-like carbon, glassy carbon, and the like.

Also, the display device mentioned in the foregoing embodiments may be formed like a two-dimensional flat display device, and is applicable to one-dimensional linear display devices. Further, when the phosphor can emit color light components of R, G, and B, a color display device can be made.

In the electron tube according to the present invention, as a predetermined pressure of hydrogen is enclosed therewithin, the surface of a field emitter made of diamond or the like is constantly terminated with hydrogen. Consequently, the electron affinity of the surface of the field emitter is maintained at a negative level. Accordingly, the electron tube equipped with this field emitter can operate efficiently and stably for a long period of time. Namely, the electron tube is expected to have a longer life.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 270786/1996 filed on Oct. 14, 1996 is hereby incorporated by reference.

What is claimed is:

1. An electron tube comprising:

an electron beam source for emitting an electron by an electric field, said electron beam source being made of diamond or a material mainly composed of diamond, said electron beam source having a surface terminated with hydrogen;

an anode for receiving the electron emitted from said electron beam source; and a sealed envelope for accommodating, at least, said electron beam source and anode, said sealed envelope enclosing hydrogen therein;

wherein hydrogen enclosed within said sealed envelope has a partial pressure within the range of $1\times10^{-6}$ to $1\times10^{-3}$ torr.

2. An electron tube according to claim 1, wherein said electron beam source is made of polycrystalline diamond.

3. An electron tube according to claim 2, wherein said electron beam source includes a field emitter for emitting said electron and having a form tapering toward said anode.

4. An electron tube according to claim 3, further comprising a control electrode for controlling the electron emitted from said field emitter, said control electrode being disposed between said field emitter and said anode.

5. An electron tube according to claim 4, further comprising a focusing electrode for converging an orbit of the electron emitted from said field emitter, said focusing electrode being disposed between said field emitter and said control electrode.

6. An electron tube according to claim 1, wherein said electron beam source comprises a plurality of field emitters each for emitting said electron and having a form tapering toward said anode, said plurality of field emitters being arranged with a predetermined interval on a surface opposing said anode.

7. An electron tube according to claim 6, further comprising a plurality of control electrodes disposed between said plurality of field emitters and said anode, said plurality of control electrodes being respectively positioned so as to correspond to said plurality of field emitters and functioning so as to control electrons emitted from said field emitters corresponding thereto.

8. An electron tube according to claim 7, further comprising a plurality of focusing electrodes, said plurality of focusing electrodes being positioned so as to correspond to said plurality of field emitters and functioning so as to converge orbits of electrons emitted from said field emitters corresponding thereto.

9. An electron tube according to claim 11, wherein said anode includes a fluorescent screen which emits light when the electron emitted from said electron beam source is incident thereon.

* * * * *